US008400124B2

(12) United States Patent
Stellberger et al.

(10) Patent No.: US 8,400,124 B2
(45) Date of Patent: Mar. 19, 2013

(54) STARTUP CIRCUIT FOR SELF-SUPPLIED VOLTAGE REGULATOR

(75) Inventors: Achim Stellberger, Kronau (DE); Frank Schwiderski, Endingen (DE)

(73) Assignee: Dialog Semiconductor GmbH, Kirchheim/Teck-Nabern (DE)

( * ) Notice: Subject to any disclaimer, the term of this patent is extended or adjusted under 35 U.S.C. 154(b) by 387 days.

(21) Appl. No.: 12/924,124

(22) Filed: Sep. 21, 2010

(65) Prior Publication Data

US 2012/0068673 A1 Mar. 22, 2012

(30) Foreign Application Priority Data

Sep. 20, 2010 (EP) ..... 10368037

(51) Int. Cl.
*G05F 1/56* (2006.01)
*G05F 1/565* (2006.01)

(52) U.S. Cl. ..... 323/275; 323/274; 323/315; 323/901

(58) Field of Classification Search ..... 323/273, 323/274, 275, 279, 280, 281, 304, 311, 315, 323/316, 901, 908; 363/49
See application file for complete search history.

(56) References Cited

U.S. PATENT DOCUMENTS

| | | | | |
|---|---|---|---|---|
| 4,051,392 | A | 9/1977 | Rosenthal et al. | |
| 4,333,047 | A | 6/1982 | Flink | |
| 4,460,951 | A | 7/1984 | Fenter et al. | |
| 4,476,428 | A | 10/1984 | Iwasawa et al. | |
| 4,567,426 | A | 1/1986 | van de Plassche et al. | |
| 4,740,742 | A | 4/1988 | Gontowski, Jr. | |
| 5,589,891 | A | 12/1996 | McCracken et al. | |
| 5,610,709 | A | 3/1997 | Arrington et al. | |
| 5,612,641 | A | 3/1997 | Sali | |
| 5,666,044 | A | 9/1997 | Tuozzolo | |
| 5,742,155 | A | 4/1998 | Susak et al. | |
| 5,969,549 | A | 10/1999 | Kim et al. | |
| 6,259,240 | B1 * | 7/2001 | Smith | 323/313 |
| 6,940,320 | B2 | 9/2005 | Sukup et al. | |
| 6,963,191 | B1 | 11/2005 | McCalmont | |
| 7,170,352 | B1 * | 1/2007 | Caldwell | 330/261 |
| 7,265,529 | B2 | 9/2007 | Nazarian | |
| 7,436,244 | B2 | 10/2008 | Lin | |
| 7,477,532 | B2 | 1/2009 | Hall et al. | |
| 7,583,070 | B2 | 9/2009 | Nazarian | |
| 7,619,397 | B2 * | 11/2009 | Al-Shyoukh | 323/281 |
| 7,719,244 | B2 | 5/2010 | Heilmann | |
| 8,269,477 | B2 * | 9/2012 | Jo | 323/313 |
| 2009/0256534 | A1 | 10/2009 | Videtich et al. | |

OTHER PUBLICATIONS

European Search Report 10368037.7-2206 Mail date Apr. 11, 2012, Dialog Semiconductor GmbH.

* cited by examiner

*Primary Examiner* — Gary L Laxton
(74) *Attorney, Agent, or Firm* — Saile Ackerman LLC; Stephen B. Ackerman

(57) ABSTRACT

A startup circuit for starting up a self-supplied voltage regulator which initiates startup by applying a voltage from a voltage supply to the startup circuit thus causing a voltage at an output node to rise. This rise will start the operation of the differential amplifier of the voltage regulator. When the voltage at the output node has reached the desired final output voltage, the startup circuit disconnects from the voltage regulator. The criterion for switching off the startup circuit is determined by a comparator which compares the output current capability of the voltage regulator with its output current plus the startup current. Inputs to the differential amplifier, such as the reference voltage, derive their power from the output node.

23 Claims, 3 Drawing Sheets

STARTUP CIRCUIT FOR SELF-SUPPLIED VOLTAGE REGULATOR

BACKGROUND OF THE INVENTION

1. Field of the Invention

The invention relates to a voltage regulator, and more particularly to a voltage regulator coupled to a startup circuit, where the latter initiates the voltage regulator and disconnects itself from the voltage regulator when the voltage regulator has reached its desired final output voltage.

2. Description of the Related Art

To increase the Power Supply Rejection Ratio (PSRR) for voltage regulators the regulator can be supplied by its own regulated voltage. This configuration needs a dedicated startup circuit to start the operation of the circuit. Common practice for the implementation of a startup circuit is to apply the startup condition as long as the output voltage of the regulator is below a certain voltage. This practice requires some voltage reference for the startup circuit and does not account for process variations. Therefore the switch-off voltage of the startup condition has to be chosen for worst case conditions to guarantee startup. This limits the output voltage range of the regulator output at the low voltage end.

This invention solves several problems associated with the related art by disclosing a self-supplied voltage regulator circuit that does not need a voltage reference for startup, is process independent, has a wider regulator output voltage range for low voltages and where the startup is always switched off at the lowest possible output voltage.

U.S. Patents which relate to the subject of the present invention are:

U.S. Pat. No. 4,051,392 (Rosenthal et al.) discloses a circuit of current amplifiers including startup circuitry.

U.S. Pat. No. 4,333,047 (Flink) discloses a current control circuit that can be used starting current during buildup of an input voltage.

U.S. Pat. No. 4,476,428 (Iwaswa et al.) discloses a power supply device comprising a reference voltage generator and a constant current circuit to create a reference voltage and a startup circuit to supply starting current to the constant current circuit.

U.S. Pat. No. 4,567,426 (van de Plassche et al.) discloses a current stabilizer with a starting circuit.

U.S. Pat. No. 4,740,742 (Gontowski, Jr.), identified by inventor, discloses a startup circuit for voltage regulator with a first and second current mirror circuit responsive to a voltage output.

U.S. Pat. No. 5,612,641 (Sali) discloses a circuit for setting initial conditions when starting up and integrated circuit device.

U.S. Pat. No. 5,666,044 (Tuozzolo), identified by the inventor, discloses a circuit providing startup capability and foldback protection to a voltage regulator.

U.S. Pat. No. 5,742,155 (Susak et al.) discloses a zero current startup circuit for a reference circuit that is initially unbiased and has internal nodes that need to be regulated.

U.S. Pat. No. 5,969,549 (Kim et al.) discloses a current detection startup circuit used to restart a reference voltage circuit.

U.S. Pat. No. 6,963,191 B1 (McCalmont) discloses a reference circuit using a low threshold FET for improved startup operation.

U.S. Pat. No. 7,265,529 B2 (Nazarian) discloses a startup circuit and method for self bias circuits to initialize operations in a stable state.

U.S. Pat. No. 7,436,244 B2 (Lin) discloses a reference circuit for reference current used in voltage generation wherein a current bias circuit provides a startup signal.

U.S. Pat. No. 7,477,532 B2 (Hall et al.) discloses a startup controller for a PWM power supply controller that is substantially independent of temperature and changes in output voltage.

U.S. Pat. No. 7,583,070 B2 (Nazarian) discloses a startup circuit for self bias circuits that provides a startup voltage and current to initialize operations in a stable state.

U.S. Patent Application Publication 2005/0077933 (Sukup et al.) discloses a power control system using separate current to control startup operation.

U.S. Patent Application Publication 2009/0021229 A1 (Heilmann) discloses a method and apparatus for enabling a voltage regulator wherein a startup circuit is connected to a bias network to assist the bias network to set an amplifier bias current during a startup time period.

It should be noted that none of the above-cited examples of the related art provide the advantages of the below described invention.

SUMMARY OF THE INVENTION

It is an object of at least one embodiment of the present invention for a startup circuit to use a current comparison between a voltage regulator's current capability and the voltage regulator's output current plus the startup circuit's current to switch off the startup condition.

It is another object of the present invention to lower the power consumption of the startup circuit for the comparison circuits.

It is yet another object of the present invention to use sense transistors to measure the voltage regulator's current capability.

It is still another object of the present invention to have the removal of the startup condition always take place at the lowest possible regulator output voltage.

These and many other objects have been achieved by applying an internally derived startup current to a startup current mirror 15 of startup circuit 11 which then sources a current to output node Vout from voltage supply VDD. The rising voltage at this output node starts at some point the amplifier 12 of the voltage regulator. A first output of the amplifier then steers a first transistor P3 and a first and second current mirror, 13 & 14, of the voltage regulator to amplify the current to the output node. The differential inputs to the amplifier are input infb and the reference voltage Vref, where Vref is derived through internal circuits (not shown). Input infb is derived from a voltage divider 17. A second transistor P2 whose gate is also coupled to the first output of the amplifier and matched to the first transistor, provides a current via a current mirror 16 to the drain of a third transistor, the sense transistor P4. This third transistor P4, which receives its input from a second output of the amplifier, also receives at its drain a current from the startup current mirror 15 of the startup circuit reflecting the startup circuit's current consumption. The startup circuit switches itself off as soon as the amplifier is able to pull up the output voltage to the desired final output voltage. This criterion is measured by the third transistor P4 because it is a direct measure of the output current capability of the voltage regulator versus the voltage regulator output current. Once the differential inputs of the amplifier get close enough to each other for the amplifier to reduce its output, the current mirror of the startup circuit switches off and the startup circuit is disconnected from the voltage regulator which is working now on its own. During normal operation there always is flowing an image of the load current through the second transistor P2. However the output current can be scaled down by matching ratios of the transistors of current mirrors 13 and 14 and first and second transistors P3/P2 such that this load current can be made smaller by two to three orders of magnitude than the actual load current and thus contributes little to the power consumption of the circuit. Likewise, the startup current ibstart that always flows through transistor N7 to VSS can be scaled down by current mirror 14 and transistors N5/N6 of current mirror 15.

These and many other objects and advantages of the present invention will be readily apparent to one skilled in the art to which the invention pertains from a perusal of the claims, the appended drawings, and the following detailed description of the preferred embodiments.

DESCRIPTION OF THE PREFERRED EMBODIMENT

Figure 1:
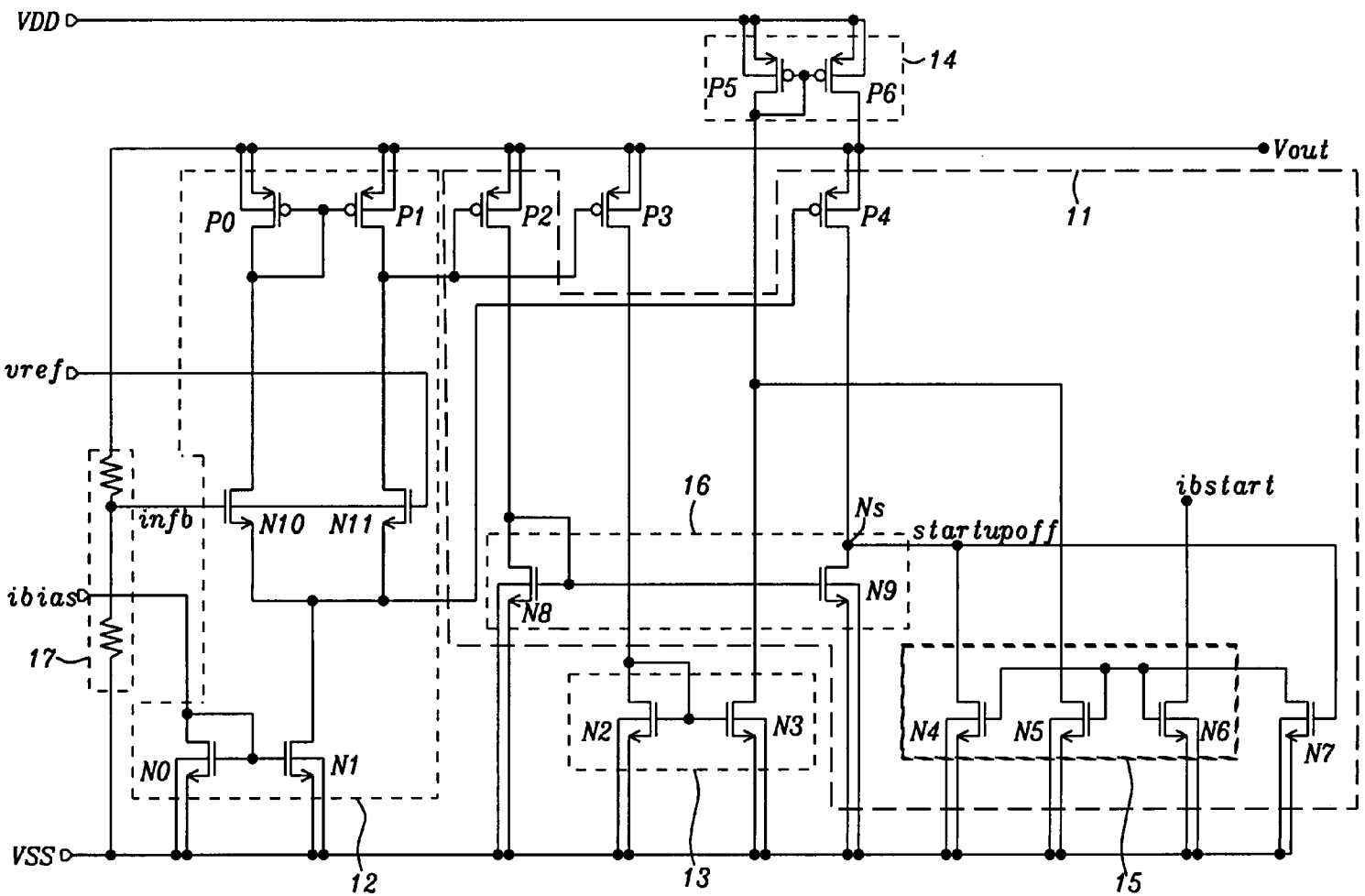
FIG. 1 is a circuit diagram of the preferred embodiment of the present invention.

We now describe the preferred embodiment of a voltage regulator which is supplied by its own regulated voltage. The self-supplied voltage regulator 10 of FIG. 1 consists of a voltage regulator and the startup circuit 11 and together comprise pmos transistors P0-P6 and nmos transistors N0-N11. The voltage regulator itself is made up of a differential amplifier 12, a steering transistor P3, and current mirrors 13 and 14. Startup circuit 11 consists of transistors P2, P4 and N7, and current mirrors 15 and 16. The function of startup circuit 11 is to bring power to amplifier 12 and to disconnect itself when the desired final output voltage is reached.

Again referring to FIG. 1, we now describe circuit 10 in detail. The differential amplifier 12 uses transistors N0, N1, N10, N11, P0, and P1 and current mirrors 13 and 14 which comprise transistors N2, N3 and P5, P6, respectively. Current mirrors 13 and 14 amplify the current from P3 to the output node "Vout". As can be seen from FIG. 1 the differential amplifier 12 gets its power from output node Vout. In addition, input bias current "ibias" and input reference voltage "vref" are generated from circuits (not shown) which get their power from the output node Vout. This configuration has the result that the operating point, where Vout=0V, is a stable operating point. Since this obviously is not the desired operating point a circuit is needed which makes this operating point unstable.

Towards that end, the startup circuit 11 (with transistors P2, P4, N7, N8, N9) and current mirror 15 (with transistors N4-N6) is used. In the beginning of the startup phase, when Vout is at 0V and power supply voltage VDD is applied, the startup current "ibstart" is generated in the VDD voltage domain (not shown). This current will bring the current mirror 15 in operation. This implies that N5 will sink current coming from P5 to the power supply return terminal VSS (typically Ground) and therefore P6 will source current to the output node Vout. This current will bring up the output voltage at output node Vout. Once the output voltage is rising the differential amplifier will start its operation at some point. The goal of the startup circuit is to switch itself off as soon as the differential amplifier itself is able to pull up the output voltage to the desired final output voltage. The criterion for this is measured with sense transistor P4. Transistor P4 measures the present state output current capability of the voltage regulator.

Differential amplifier 12 is able to pull the node "outamp" to the source potential of transistor N11 when N11 is switched through completely. The gate of sense transistor P4 is connected to the source of N11 which means that P4 is a direct measure of the output current capability because P2, P3 and P4 are matching transistors. The current through transistor P2 is an image of the current through P3 which is an image of the output current. The current through P2 is mirrored through transistors N8/N9 into the drain of P4.

Also, an image of the startup current ibstart which is flowing through N4 is mirrored into the drain of P4. During startup, when the input voltage at node "infb" is smaller than the voltage at node vref, the differential amplifier will always try to output its maximum current. This means that the current capability of N9 equals that of transistor P4 but also that N4 is able to sink the startup current ibstart to VSS and therefore holds node "startupoff" (Ns) at VSS.

Once the voltage at node infb is close enough to input vref that the differential amplifier reduces its output current "outamp" at node outamp, the current capability through N9 becomes smaller and node startupoff (Ns) is pulled up by P4.

At the moment when the current capability of P4 exceeds that of transistors N4 and N9 together, the node startupoff is pulled up to the Vout level. Because node startupoff is pulled up, transistor N7 is turned on and switches off the current mirror 15 by sinking the startup current ibstart to VSS. This then stops the mirrored startup current flowing from P5, through N5, and P6 then will no longer source startup current from VDD to output node Vout.

At this moment the voltage regulator is working on its own without being disturbed by the startup circuit. Since the voltage regulator's current capability is higher than what is needed to bring up the output voltage Vout, the voltage regulator will bring node infb up to vref, via voltage divider 17 which is coupled to Vout, and start normal operation.

The criterion to switch off the startup therefore is that the current capability of the voltage regulator, measured by sense transistor P4, is higher than the startup current, measured by N4 plus the actual output current of the voltage regulator measured by P2 (and then mirrored to N9).

During normal operation there always will be flowing an image of the load current through P2. But since the output current can be scaled down by the matching ratios of P5/P6, N2/N3 and P3/P2, this current through P2 can easily be made smaller by two to three orders of magnitude than the actual load current and therefore does not contribute considerably to the power consumption of the circuit. The same is true for the startup current ibstart that always will be flowing through N7 to VSS. But this also can be scaled down with the matching ratios of P5/P6 and N5/N6.

The advantages of the startup circuit implementation described above are that the switch-off criterion does not depend on any process parameters, that the power consumption of the startup circuit is negligible and that no external voltage reference is needed. In addition, the startup circuit is always switched off at the point where the voltage regulator is just able by itself to pull up the output voltage and therefore at the lowest possible output voltage at which the regulator can operate. This improves the operating range of the regulator towards low output voltages.

We now provide a further description of the preferred embodiment of a startup circuit for a self-supplied voltage regulator 10 by referring again to FIG. 1.

A voltage regulator regulates the output voltage Vout, where the output voltage is derived from the power supply voltage VDD, where the voltage regulator is coupled to the startup circuit 11, and where the amplifier means 12 of the voltage regulator produces the output voltage.

The startup circuit initiates a startup by having a current applied to input ibstart of the startup circuit which causes the power supply VDD to bring up the output voltage at output node Vout thereby starting operation of the amplifier means. The startup circuit switches off when the amplifier means pulls up the output voltage to the desired final output voltage.

A comparator, comprising transistors P4 and N9, of the startup circuit compares the output current capability of the voltage regulator with the startup current ibstart of the startup circuit plus output currents "outamp" of the voltage regulator. The comparator switches off the startup circuit when the output current capability is higher than the startup current plus the output currents of the voltage regulator.

Scaling circuits comprising current mirrors scale down currents of the startup circuit to reduce its current consumption.

The amplifier means 12 comprises a differential amplifier having differential inputs, where the first of the differential inputs is reference voltage Vref and where the second of the differential inputs is infb, which is derived internally from voltage divider 17, the latter coupled to output node Vout, and where the differential amplifier is coupled to output node Vout.

The startup circuit 11 comprises a current mirror 15, where the input of the current mirror is coupled to input ibstart of the startup circuit, and where the output of the current mirror is coupled to the comparator (transistors P4 and N9) to supply the startup current to the comparator.

A sense circuit comprising transistors P4 and N4, measures the voltage regulator's current capability.

Figure 2:
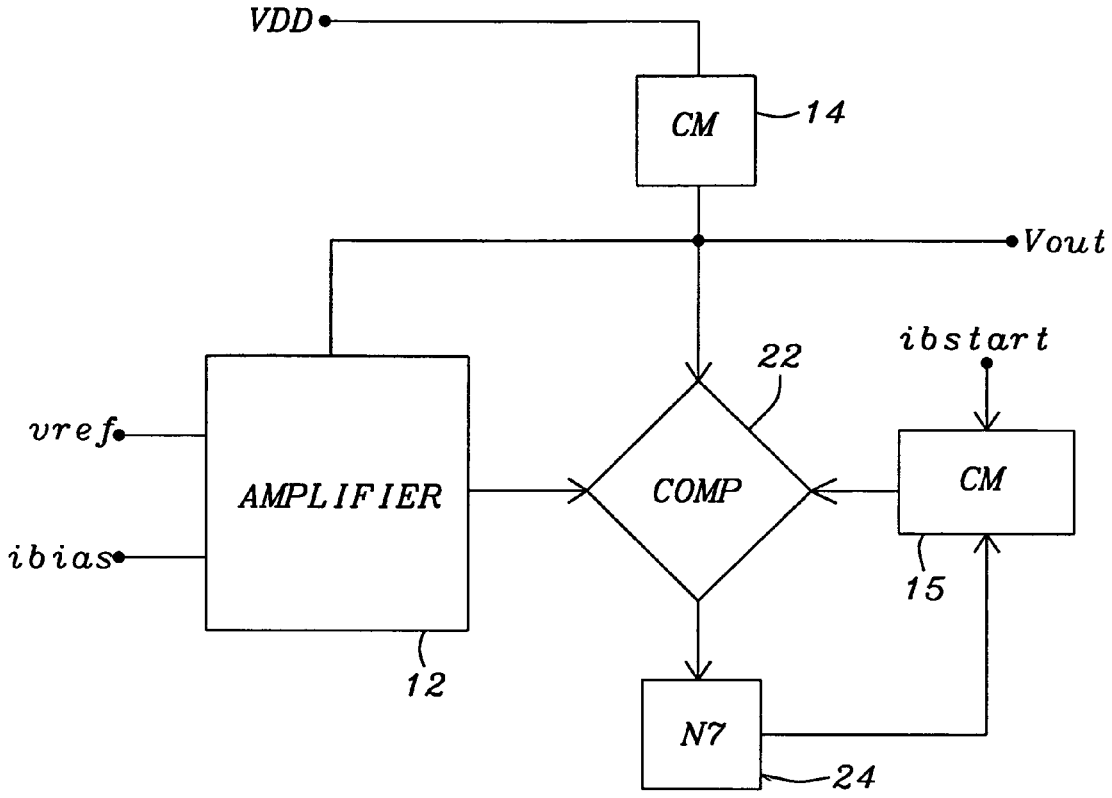
FIG. 2 is a block diagram of FIG. 1.

Next we describe in FIG. 2 the block diagram of the startup circuit. The startup circuit comprises Amplifier 12 (the Voltage Regulator), Current mirror 14, Comparator 22, Current mirror 15, and Block 24 (N7). Amplifier 12, receives inputs vref and infb, where infb is derived internally (not shown) and is coupled to Comparator 22. Current mirror 14 receives power from voltage supply VDD and brings up line Vout during the startup phase. Vout is also an input to Comparator 22. Current mirror 15 receives input ibstart and is coupled to Comparator 22. During startup, the current from ibstart activates Current mirror 15 and causes Current mirror 14 to bring up line Vout, as already mentioned. As the voltage on line Vout rises, amplifier 12 will start its operation and Comparator 22 compares the current capability of Amplifier 12 (the Voltage Regulator) with the startup circuit's startup current plus the actual output current of Amplifier 12. When Comparator 22 determines that the Voltage Regulator's current capability and output current match, Comparator 22 sends a signal to Block 24 (N7). Block 24 (N7), coupled to Current mirror 15, turns off Current mirror 15 and the startup circuit disconnects from the voltage regulator, thus ending the startup sequence.

Figure 3:
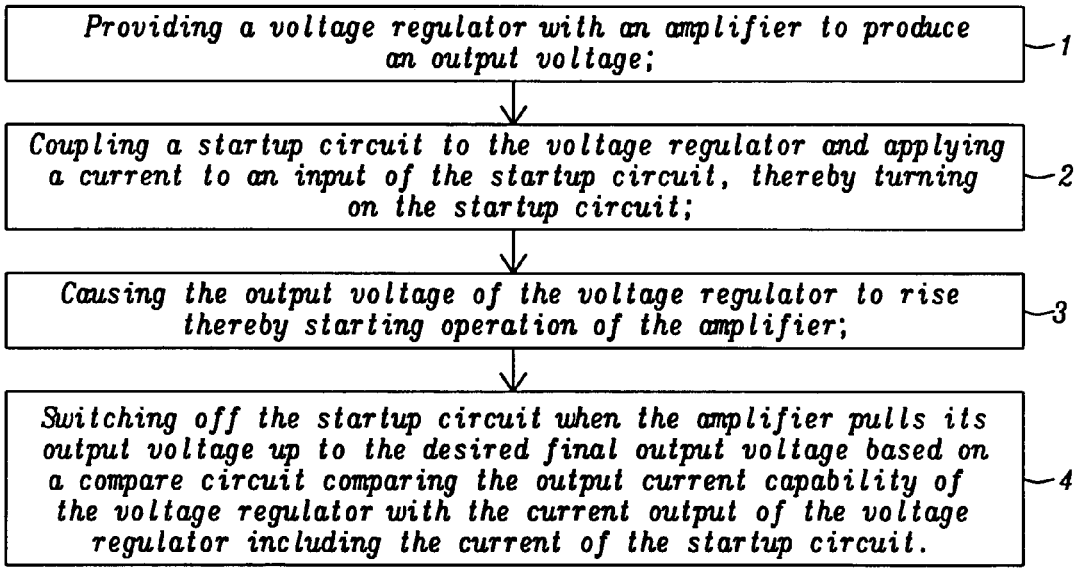
FIG. 3 is a block diagram of the method of the invention.

We now describe with reference to FIG. 3 a preferred method of the present invention to provide a startup circuit using current comparison between the current capability of a voltage regulator and the output current of that voltage regulator plus the current of the startup circuit:

Block 1 provides a voltage regulator with an amplifier to produce an output voltage;

Block 2 couples a startup circuit to the voltage regulator and applies a current to an input of the startup circuit thereby turning on the startup circuit;

Block 3 causes the output voltage of the voltage regulator to rise thereby starting operation of the amplifier; and Block 4 switches off the startup circuit when the amplifier pulls its output voltage up to the desired final output voltage based on a compare circuit comparing the output current capability of the voltage regulator with the output current of the voltage regulator including the current of the startup circuit.

ADVANTAGES

Advantages of this invention are:

No voltage reference is needed;

There is a wider regulator output voltage range for low voltages;

There is no process variation dependence on startup switch-off;

Startup is always switched off at the lowest possible output voltage;

Low power consumption for the startup circuit.

Amplifier means implies a device which amplifies a signal, and may be a transistor or a transistor circuit, either of these in discrete form or in integrated circuits (IC), a relay. These devices are cited by way of illustration and not of limitation, as applied to amplifier means.

Current mirror means implies an active device used for biasing elements and load devices for amplifiers, and may be transistors or a transistor circuit, either of these in discrete form or in integrated circuits (IC). These devices are cited by way of illustration and not of limitation, as applied to impedance matching means.

While the invention has been particularly shown and described with reference to the preferred embodiments thereof, it will be understood by those skilled in the art that various changes in form and details may be made without departing from the spirit and scope of the invention.

What is claimed is:

1. A startup circuit for a self-supplied voltage regulator, comprising:

a voltage regulator to provide an output voltage at an output node, where an amplifier means of said voltage regulator regulates said output voltage;

a startup circuit coupled to said voltage regulator, said startup circuit starting the operation of said amplifier means;

a comparator to compare an output current capability of said voltage regulator with a startup current of said startup circuit plus output currents of said voltage regulator;

sense circuits to measure said output current capability of said voltage regulator; and circuits to disconnect said startup circuit from said voltage regulator when said amplifier means reaches a desired final output voltage.

2. The startup circuit for a self-supplied voltage regulator of claim 1, wherein said comparator switches off said startup circuit when said output current capability of said voltage regulator, as measured by said sense circuits, is higher than said startup current plus said output currents of said voltage regulator.

3. The startup circuit for a self-supplied voltage regulator of claim 1, wherein scaling circuits comprising current mirrors scale down currents of said startup circuit.

4. The startup circuit for a self-supplied voltage regulator of claim 1, wherein said amplifier means comprises a differential amplifier having a differential input, where a first of said differential inputs is a reference voltage and where a second of said differential inputs is derived internally from a voltage divider coupled to said output node, and where said differential amplifier is coupled to said output node.

5. The startup circuit for a self-supplied voltage regulator of claim 4, wherein said circuits disconnect said startup circuit from said voltage regulator by reducing the current through said differential amplifier based on a voltage rise of said second of said differential inputs to the level of said reference voltage.

6. A startup circuit for a self-supplied voltage regulator, comprising:

a voltage regulator to regulate an output voltage, where said output voltage is derived from a power supply voltage, said voltage regulator coupled to a startup circuit, where an amplifier means of said voltage regulator produces said output voltage;

said startup circuit to initiate a startup by having a current applied to an input of said startup circuit which causes said power supply to bring up said output voltage at an output node, thereby starting operation of said amplifier means, where said startup circuit switches off when said amplifier means pulls up said output voltage to a desired final output voltage;

a comparator of said startup circuit to compare an output current capability of said voltage regulator with a startup current of said startup circuit plus output currents of said voltage regulator, where said comparator switches off said startup circuit when said output current capability is higher than said startup current plus said output currents of said voltage regulator; and scaling circuits comprising current mirrors to scale down currents of said startup circuit.

7. The startup circuit for a self-supplied voltage regulator of claim 6, wherein said amplifier means comprises a differential amplifier having differential inputs, where a first of said differential inputs is a reference voltage and where a second of said differential inputs is derived internally from a voltage divider coupled to said output node and where said differential amplifier is coupled to said output node.

8. The startup circuit for a self-supplied voltage regulator of claim 6, wherein said startup circuit comprises a current mirror, where an input of said current mirror is coupled to said input of said startup circuit, and where an output of said current mirror is coupled to said comparator to supply said startup current to said comparator.

9. The startup circuit for a self-supplied voltage regulator of claim 6, wherein a sense circuit measures said voltage regulator's current capability.

10. A startup circuit for a self-supplied voltage regulator, comprising:

a voltage regulator to regulate an output voltage of said voltage regulator, said voltage regulator further comprising:

an amplifier means for amplifying a differential input voltage to produce said output voltage at an output node (Vout) and to further provide control voltages as inputs to a startup circuit, where said amplifier means will start its operation once said output voltage rises;

a first pmos transistor its input coupled to a first of said control voltages to receive a steering current;

first current mirror means, its input coupled to said first pmos transistor to mirror the current of said first pmos transistor; and second current mirror means coupled between the output of said first current mirror means and an external power supply (VDD), where the output of said second current mirror means couples to said output node (Vout) to provide a source of current and a rising voltage to said output node (Vout);

said startup circuit for initiating and terminating the startup of said voltage regulator, said startup circuit further comprising:

third current mirror means having an external input (ibstart) to provide a current derived from said external power supply, where said third current mirror means provides signals at its output for said initiation of said startup and further to terminate the startup of said voltage regulator;

a current comparator to effect a current comparison between an output current capability of said voltage regulator and its output current including the current used by said startup circuit, where when said output current of said startup circuit predominates, said startup circuit initiates said startup of said voltage regulator, and when said output current capability of said voltage regulator predominates, said startup circuit terminates said startup of said voltage regulator;

a second pmos transistor coupled to said output node (Vout), its input coupled to a first of said control voltages to provide a current for current mirroring;

fourth current mirror means, its input coupled to said second pmos transistor, said fourth current mirror means to provide at its output, at a node Ns, a mirrored current; and a third pmos transistor, a sense transistor, its input coupled to a second of said control voltages to steer said third pmos transistor, said third pmos transistor coupled between said output node (Vout) and said node Ns, to measure said output current capability of said voltage regulator.

11. The startup circuit for a self-supplied voltage regulator of claim 10, wherein said amplifier means comprises a differential amplifier, where said differential input voltage is derived from an external and an internal input, and a first and a second output to provide said control voltages, said differential amplifier providing regulation for said voltage regulator where said first and second outputs provide steering currents for current mirrors of said startup circuit.

12. The startup circuit for a self-supplied voltage regulator of claim 10, wherein said external input of said third current mirror means is generated from said external power supply.

13. The startup circuit for a self-supplied voltage regulator of claim 10 wherein an input of said second current mirror means is coupled to an output of said first current mirror means, where the output of said second current mirror means is coupled to said output node (Vout), and where said first current mirror means and said second current mirror means amplify the current from said first pmos transistor to said output node (Vout).

14. The startup circuit for a self-supplied voltage regulator of claim 10, wherein a nmos transistor is coupled in parallel to said third current mirror, where the gate of said nmos transistor is coupled to said node Ns, said nmos transistor switching off said third current mirror when said third pmos transistor, said sense transistor, turns on.

15. The startup circuit for a self-supplied voltage regulator of claim 11, wherein the gate of said first pmos transistor is coupled to said first output of said amplifier means, said first pmos transistor providing a current for said first current mirror means, where said first pmos transistor is coupled between said output node (Vout) and an input of said first current mirror means.

16. The startup circuit for a self-supplied voltage regulator of claim 11, wherein the gate of said second pmos transistor is coupled to said first output of said amplifier means, said second pmos transistor coupled to the input of said fourth current mirror means, and where a current through said second pmos transistor is mirrored through said fourth current mirror into said third pmos transistor.

17. The startup circuit for a self-supplied voltage regulator of claim 11, wherein said third pmos transistor is coupled between said output node (Vout) and the output of said fourth current mirror means, where the gate of said third pmos transistor is coupled to said second output of said amplifier means, said third pmos transistor measuring the output current capability of said voltage regulator.

18. The startup circuit for a self-supplied voltage regulator of claim 10, wherein said third current mirror means having its input coupled to a startup current supply, where a first output of said third current mirror means is coupled to the junction of said input of said second current mirror means and said output of said first current mirror means, where during a startup phase said first output of said third current mirror means will sink current coming from said input of said second current mirror means.

19. The startup circuit for a self-supplied voltage regulator of claim 10, wherein a second output of said third current mirror means is coupled to said node Ns, said second output of said third current mirror means mirroring an image of said startup current into the drain of said third pmos transistor.

20. The startup circuit for a self-supplied voltage regulator of claim 11, wherein said external input of said amplifier means is generated from a circuit which derives its power from said output node (Vout).

21. The startup circuit for a self-supplied voltage regulator of claim 11, wherein said internal input of said amplifier means is generated from a voltage divider which derives its power from said output node (Vout).

22. A method of providing a startup circuit for a self-supplied voltage regulator, comprising the steps of:

a) providing a voltage regulator with an amplifier to produce an output voltage;

b) coupling a startup circuit to said voltage regulator and applying a current to an input of said startup circuit, thereby turning on said startup circuit;

c) causing said output voltage of said voltage regulator to rise thereby starting operation of said amplifier; and d) switching off said startup circuit when said amplifier pulls its output voltage up to the desired final output voltage based on a compare circuit to compare the output current capability of said voltage regulator with the output current of said voltage regulator including the current of said startup circuit.

23. The method of claim 22, wherein the current consumption of said startup circuit is reduced by scaling down the current through matching ratios of transistors used in said startup circuit.

* * * * *